US007777706B2

(12) United States Patent
Lee et al.

(10) Patent No.: US 7,777,706 B2
(45) Date of Patent: Aug. 17, 2010

(54) IMPULSE DRIVING APPARATUS AND METHOD FOR LIQUID CRYSTAL DEVICE

(75) Inventors: Ssu-Ming Lee, Taipei County (TW); Seob Shin, Taoyuan (TW); Feng-Ting Pai, Hsinchu (TW); Hsien-Wen Chou, Taoyuan County (TW)

(73) Assignee: Hannstar Display Corporation, Taipei County (TW)

( * ) Notice: Subject to any disclaimer, the term of this patent is extended or adjusted under 35 U.S.C. 154(b) by 724 days.

(21) Appl. No.: 10/907,741

(22) Filed: Apr. 14, 2005

(65) Prior Publication Data

US 2005/0270873 A1 Dec. 8, 2005

(30) Foreign Application Priority Data

Jun. 7, 2004 (TW) ..... 93116297 A

(51) Int. Cl.
*G09G 3/36* (2006.01)

(52) U.S. Cl. ..... 345/87; 345/55

(58) Field of Classification Search ..... 345/87–90, 345/55, 38, 99, 39
See application file for complete search history.

(56) References Cited

U.S. PATENT DOCUMENTS 6,473,077 B1 * 10/2002 Takenaka et al. ..... 345/209
6,947,034 B2 * 9/2005 Kwon ..... 345/204
7,038,651 B2 * 5/2006 Nitta et al. ..... 345/98
7,199,780 B2 * 4/2007 Sekine ..... 345/102
7,518,587 B2 * 4/2009 Lee et al. ..... 345/98
2001/0003448 A1 * 6/2001 Nose et al. ..... 345/99
2002/0084959 A1 * 7/2002 Park et al. ..... 345/87
2002/0109654 A1 * 8/2002 Kwon ..... 345/87
2004/0017342 A1 * 1/2004 Sekine ..... 345/87
2005/0253794 A1 * 11/2005 Lee et al. ..... 345/87
2005/0259063 A1 * 11/2005 Kwon ..... 345/98
2007/0046601 A1 * 3/2007 Shin et al. ..... 345/89

* cited by examiner

*Primary Examiner*—Alexander Eisen
*Assistant Examiner*—Jason M Mandeville
(74) *Attorney, Agent, or Firm*—Jianq Chyun IP Office

(57) ABSTRACT

An impulse driving method and apparatus for liquid crystal device are provided. A data driver of the LCD outputs pixel data signals for driving pixels of the LCD at a first level of the load signal. Next, the data driver outputs black data signals for driving pixels of the LCD at a second level of the load signal. Thus, the image dragging problem is resolved by using the impulse driving method and apparatus according to an embodiment of the present invention, and the need of double frequency for the load signal is prevented.

20 Claims, 5 Drawing Sheets

IMPULSE DRIVING APPARATUS AND METHOD FOR LIQUID CRYSTAL DEVICE

CROSS-REFERENCE TO RELATED APPLICATION

This application claims the priority benefit of Taiwan application serial no. 93116297, filed on Jun. 7, 2004. All disclosure of the Taiwan application is incorporated herein by reference.

BACKGROUND OF THE INVENTION

1. Field of Invention

The present invention relates to a liquid crystal device. More particularly, the present invention relates to an impulse driving apparatus and method thereof for liquid crystal devices.

2. Description of Related Art

Recently, the cathode ray tube (CRT, herein after) display devices are gradually being replaced by liquid crystal displays. The improvements of semiconductor technology enable liquid crystal displays to deliver many benefits including low power consumption, slim shape, light weight, high resolution, good color saturation, and long product life. Hence liquid crystal displays are widely used in electronic devices, such as display screens of portable computers or desktop computers, televisions (TVs), etc. Wherein, the quality of a liquid crystal device is the key factor for a good quality liquid crystal display.

Referring to FIG. 1, the block diagram of a conventional thin film transistor LCD is shown. Wherein, a data driver 110 drives a plurality of data lines 112~118 to output data signals for driving pixels, a gate driver 130 drives a plurality of gate lines 132~138 that are also known as scan lines, and a display area 120 includes a plurality of transistors 152~168 and storage capacitors 181~197.

The operation of a conventional liquid crystal display is described as follows. First, a gate line, e.g. gate line 132 is driven for turning on the transistors 152~156 on the gate line 132. At the same time, pixel data signals for displaying are inputted through data lines 112~118 to charge storage capacitors 181~185. Then, the next gate line is driven, e.g. gate line 134, and the pixel data signals for displaying are inputted through data lines 112~118 to charge storage capacitors 187~191. Accordingly, storage capacitors 181~197 in the display area 120 are charged in sequence for displaying a complete image.

The operations described above are perfect for displaying a static image. But an image dragging will occur to the dynamic image with a fast refresh speed while the voltage charged to storage capacitors can not be refreshed in time. In order to resolve the problem of image dragging when displaying dynamic images, the Samsung Electronics of Korea had proposed an impulse driving liquid crystal display by emulating CRT operations according to the Korea patent No. 2002-0066823, which is published on Aug. 21, 2002.

Referring to FIG. 2, an operating timing diagram of the impulse driving liquid crystal display proposed by Samsung Electronics is shown. Wherein, DATA is an image data on data line for driving pixels, STH is a start horizontal signal, TP is a load signal, CPV is a gate clock signal, and STV is a start vertical signal. In order to emulate the impulse display operations of a CRT, the image data DATA is outputted as the pixel data with a black data inserted in 1H cycle of the scan line, as shown in FIG. 2. Then a data driver receives and stores the image data on data lines and generates data signals for driving pixels according to the start horizontal signal STH and the load signal TP. Meanwhile, a gate driver generates scan signals for driving gate lines according to the gate clock signal CPV and the start vertical signal STV.

However, according to the timing diagram in FIG. 2, the aforementioned method requires double frequency for the start horizontal signal STH and the load signal TP compared to the operation of a conventional liquid crystal display and hence limiting the charging time for storage capacitors to only half of the original charging time or even less. Furthermore, additional line memories are required because pixel data and black data are transmitted alternately.

SUMMARY OF THE INVENTION

Accordingly, the present invention is directed to an impulse driving method for liquid crystal device (LCD, herein after), wherein double frequency signals are not needed so as to improve the aforementioned problems.

The present invention is also directed to an impulse driving apparatus for LCD using only regular frequency signals without additional line memories.

According to an embodiment of the present invention, an impulse driving method for LCD is provided. Wherein a data driver of the LCD outputs data signals to drive pixels of the LCD according to a received load signal. The said impulse driving method for LCD comprises following procedures. At a first level of the load signal, a data driver outputs normal signals for driving pixels of the LCD. Next, at a second level of the load signal, the data driver outputs auxiliary signals for driving pixels of the LCD. According to an embodiment of the present invention, the normal signal is a pixel data signal and the auxiliary signal may be a black data signal or a white data signal.

Furthermore, the voltage level of the aforementioned auxiliary signal may be generated by an internal circuit of the data driver integrated circuit or by an external circuit.

Therefore, the gate driver of the LCD generates scan signals for controlling a plurality of gate lines according to the start vertical signal and gate clock signal. When the data driver outputs normal signals, the gate driver conducts the $i^{th}$ gate line. Next, the data driver outputs auxiliary signals, the gate driver conducts the $i+j^{th}$ gate line to eliminate the pixel data selected by the $i+j^{th}$ gate line. Thus, an impulse driving signal is generated as required. Certainly, besides the $i+j^{th}$ gate line, the gate driver may conduct a $i+j+2^{th}$, a $i+j+4^{th}$ . . . etc. gate lines concurrently to eliminate the pixel data selected by the $i+j+2^{th}$, the $i+j+4^{th}$ . . . etc. gate lines. Thus, the required impulse driving signals are generated.

According to another embodiment of the present invention, an impulse driving apparatus for LCD comprises a timing controller, a data driver and a gate driver. Wherein, the timing controller outputs image data and control signals including a load signal, a start vertical signal and a gate clock signal. The data driver is coupled to the timing controller to output pixel data signals for driving the LCD pixels when at a first level of the load signal. The data driver further outputs black data signals for driving the LCD pixels when at the second level of the load signal. The gate driver is coupled to the timing controller to generate scan signals for controlling a plurality of gate lines according to the start vertical signal and gate clock signal. Wherein, a normal signal comprises the said pixel data signal, and an auxiliary signal comprises the said black data signal as well as a white data signal.

Furthermore, the voltage level of the aforementioned auxiliary signal may be generated by an internal circuit of the data driver integrated circuit or by an external circuit.

According to an embodiment of the present invention, when the data driver outputs the pixel data signals, the gate driver conducts the $i^{th}$ gate line. Then the data driver outputs black data signals, the gate driver conducts the $i+j^{th}$ gate line to eliminate the pixel data selected by the $i+j^{th}$ gate line. Thus, the required impulse driving signal is generated.

In another aspect, when the data driver outputs pixel data signals, the gate driver conducts the $i^{th}$ gate line. Then the data driver outputs black data signals, the gate driver conducts the $i+j^{th}$, the $i+j+2^{th}$, and the $i+j+4^{th}$ . . . etc. gate lines concurrently to eliminate the pixel data selected by the $i+j^{th}$, the $i+j+2^{th}$, and the $i+j+4^{th}$ . . . etc. gate lines. Thus, the required impulse driving signals are generated.

According to an embodiment of the present invention, the first level of the load signal is a low voltage level, while the second level of the load signal is a high voltage level.

The impulse driving method and apparatus for LCD according to an embodiment of the present invention utilizes different voltage levels of the load signal for loading pixel data signals and black data signals. Hence the needs of double frequency for the start horizontal signal and the load signal are prevented, and the charging time of the storage capacitor can keep under control. Furthermore, since the timing controller does not need to transmit the pixel data and the black data to the data driver alternately, and therefore the cost of the system can be effectively reduced as comparatively less quantity of line memories are required.

In order to the make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 3:
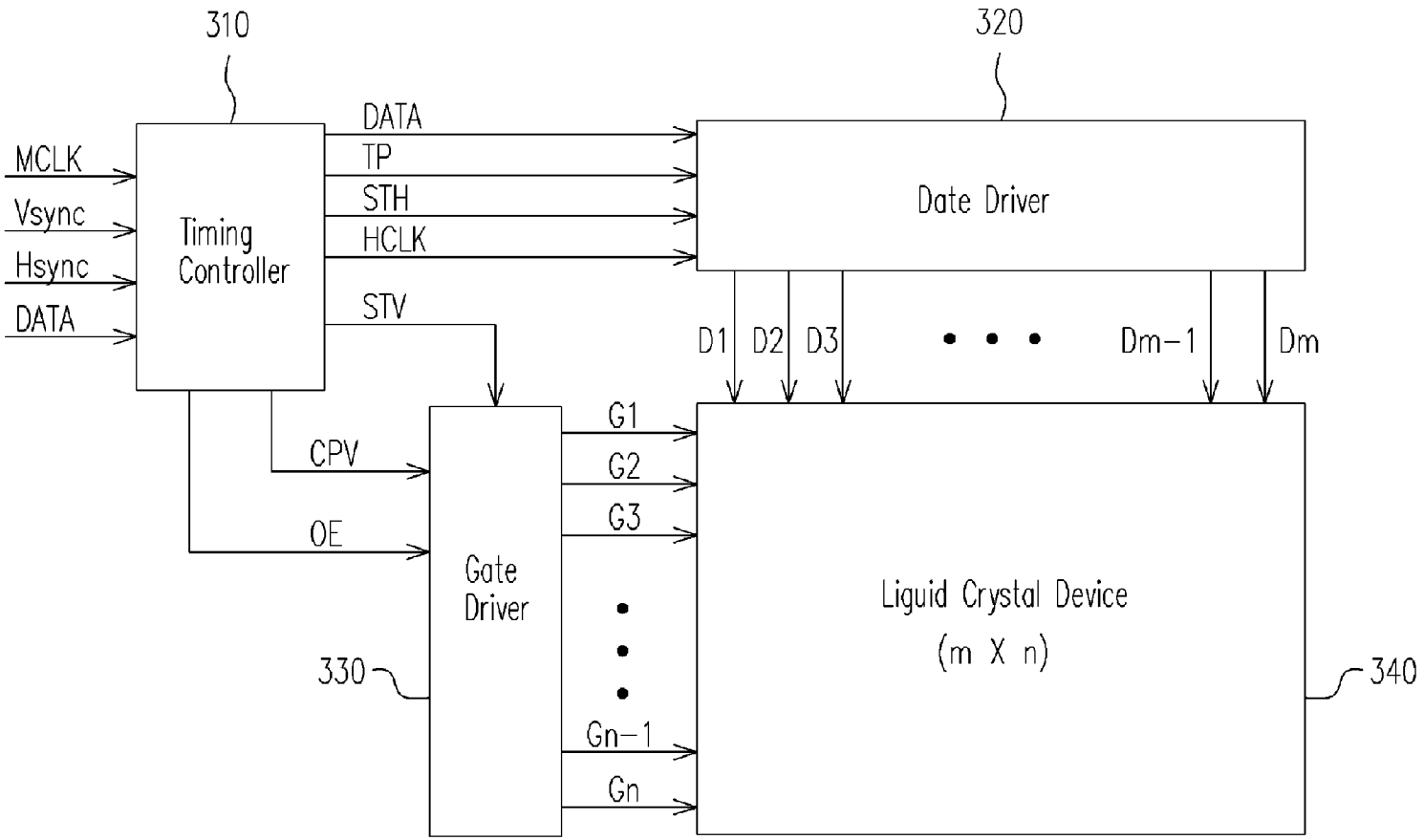
FIG. 3 is a schematic block diagram of an impulse driving apparatus for liquid crystal device according to an embodiment of the present invention.

Referring to FIG. 3, a schematic block diagram of an impulse driving apparatus for LCD according to an embodiment of the present invention is shown. As shown in FIG. 3, the apparatus comprises a timing controller 310, a data driver 320 and a gate driver 330, for driving the LCD 340.

Wherein, the timing controller 310 outputs image data DATA and control signals including a load signal TP, a start vertical signal STH, a horizontal clock signal HCLK, a start vertical signal STV, a gate clock signal CPV and an output enable signal OE. According to the aforementioned image data and control signals outputted from the timing controller 310, the data driver 320 and the gate driver 330 generate data signals and scan signals for driving the LCD 340. Accordingly, the data signals are conducted pixels on the correct scan lines for displaying, when the scan signals are sequentially outputted from gate lines G1 till Gn and the data signals are transmitted from data lines D1 till Dm. The detailed operating timing diagrams are shown in FIG. 4 and FIG. 5.

Figure 4:
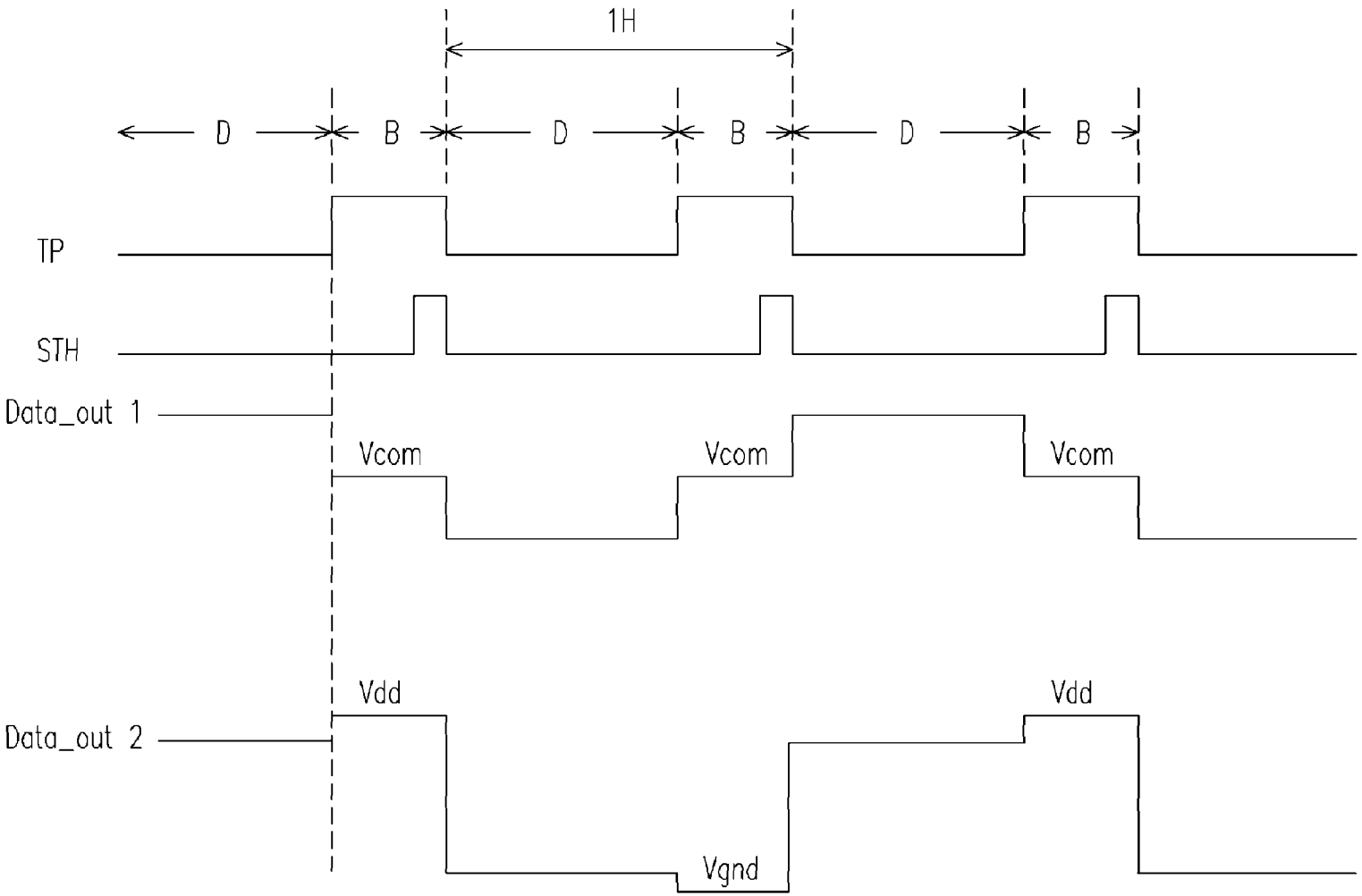
FIG. 4 is an operating timing diagram of a data driver of an impulse driving apparatus for liquid crystal device according to an embodiment of the present invention.
Figure 5:
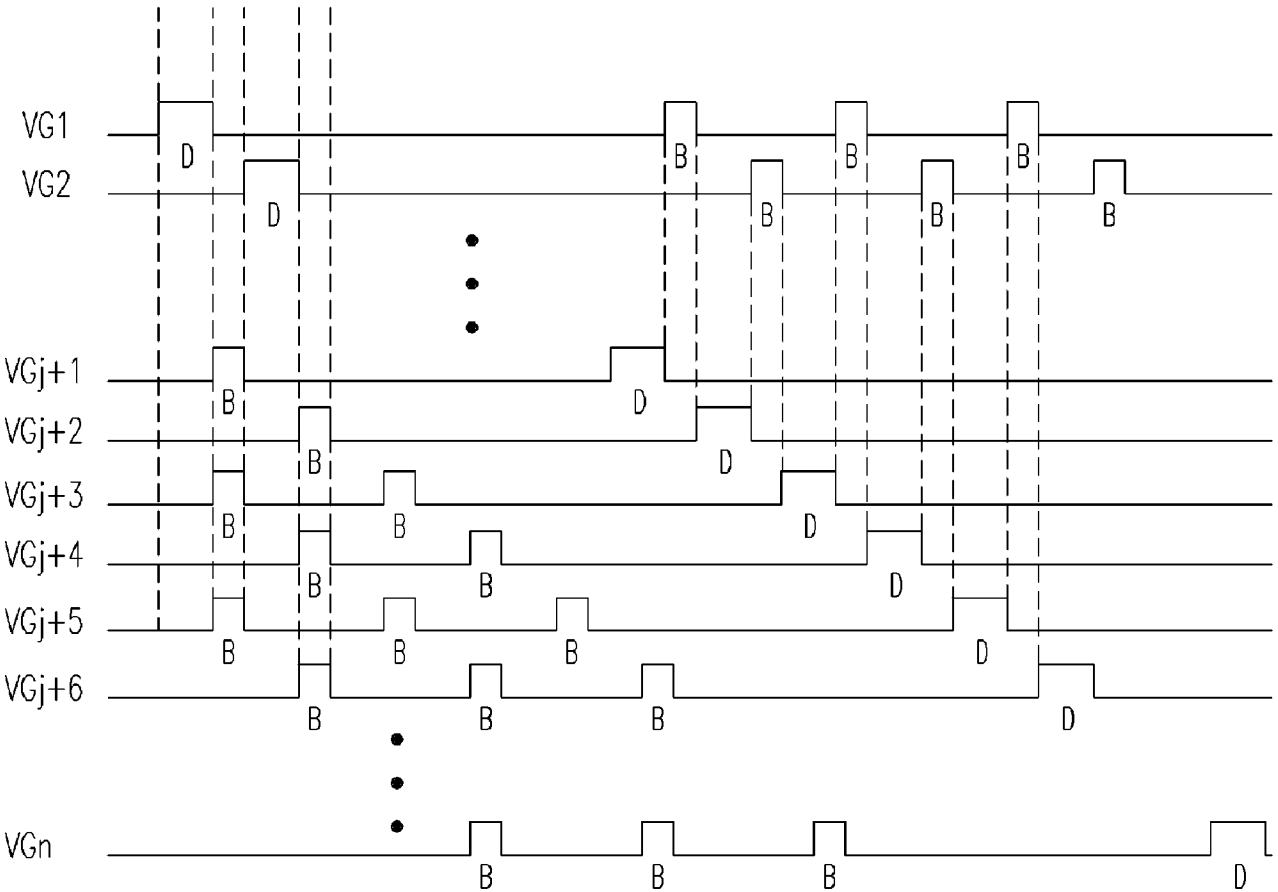
FIG. 5 is an operating timing diagram of a gate driver of an impulse driving apparatus for liquid crystal device according to an embodiment of the present invention.

Referring to FIG. 4, an operating timing diagram of the data driver of an impulse driving apparatus for liquid crystal device according to an embodiment of the present invention is shown. Besides the load signal TP and the start horizontal signal STH, the operating timing for the data signal Data_out1 in a normally black LCD and the data signal Data_out2 in a normally white LCD are also shown. Wherein, the data driver 320 receives the image data DATA from the timing controller 310 according to the start horizontal signal STH, as well as outputs normal signals D and auxiliary signals B for driving the LCD 340 according to the voltage level of the load signal TP. The aforementioned normal signals may be the pixel data signals for example, while the auxiliary signals may be black data signals or white data signals. Although the pixel data signals and the black data signals are adopted according to the embodiment of present invention, yet the scope of the present invention is not limited to above descriptions.

The aforementioned pixel data signal D is the gamma voltage value equivalent to the normal data for displaying, while the auxiliary signal B is the gamma voltage value which displays a pixel black or white. Namely, when the LCD is normally black, the auxiliary signal B is the gamma voltage value equivalent to Vcom, as shown by the data signal Data_out1. When the LCD is normally white, the auxiliary signal B is the gamma voltage value equivalent to a high voltage level Vdd or a low voltage level Vgnd, as shown by the data signal Data_out2.

Furthermore, the voltage level of the auxiliary signal, e.g. voltage level of the aforementioned black data signal, may be generated by an internal circuit of the data driver integrated circuit or generated by an external circuit. When the auxiliary signal is generated by an internal circuit of the driver integrated circuit, the voltage level of the auxiliary signal may choose the gamma voltage value of black pixel, e.g. in above descriptions, or Vdd at a positive time frame period ("positive field" hereinafter) and Vgnd at a negative time frame period ("negative field" hereinafter). When the auxiliary signal is generated by an external circuit, the voltage level may have a constant voltage level for a DC (direct current) mode, or different voltage levels at the positive field and the negative field for an AC (alternating current) mode. As known in the art, the DC mode is adaptive to normally black data, however, the AC mode is adaptive to normally white data. Accordingly, another technical feature and accomplishments of the present invention is provided. The voltage level of the aforementioned auxiliary signal may be adjusted facilely, and the root mean square value of the data signal for driving liquid crystal display can be adjusted by changing the voltage level of the auxiliary signal.

Accordingly, the operating timing of the data driver 320 is as follows. When the load signal TP is at the first level, e.g. a low voltage level, the pixel data signal D is outputted for driving the pixel of LCD 340. When the load signal TP is at the second level, e.g. a high voltage level, the black data signal B is outputted for driving the pixel of LCD 340 in order to reset the pixel voltage on the scan line, thereby to generate the impulse driving effect.

In another aspect, a normal cycle D is defined when the load signal is at the first level within a cycle time of the start horizontal signal STH, i.e. within 1H cycle of each scan line. Meanwhile, an auxiliary cycle B is defined when the load signal is at the second level within the cycle time of the start horizontal signal STH. Therefore, the feature of an impulse driving method according to the present invention is as follows. During a normal cycle D, the data driver outputs normal signals, e.g. pixel data signals, for driving the pixels of the LCD 340; during an auxiliary cycle B, the data driver outputs auxiliary signals, e.g. black data signals, for driving the pixels of the LCD 340 to reset the pixel voltage on scan lines, thereby generate the impulse driving effect.

Figure 1:
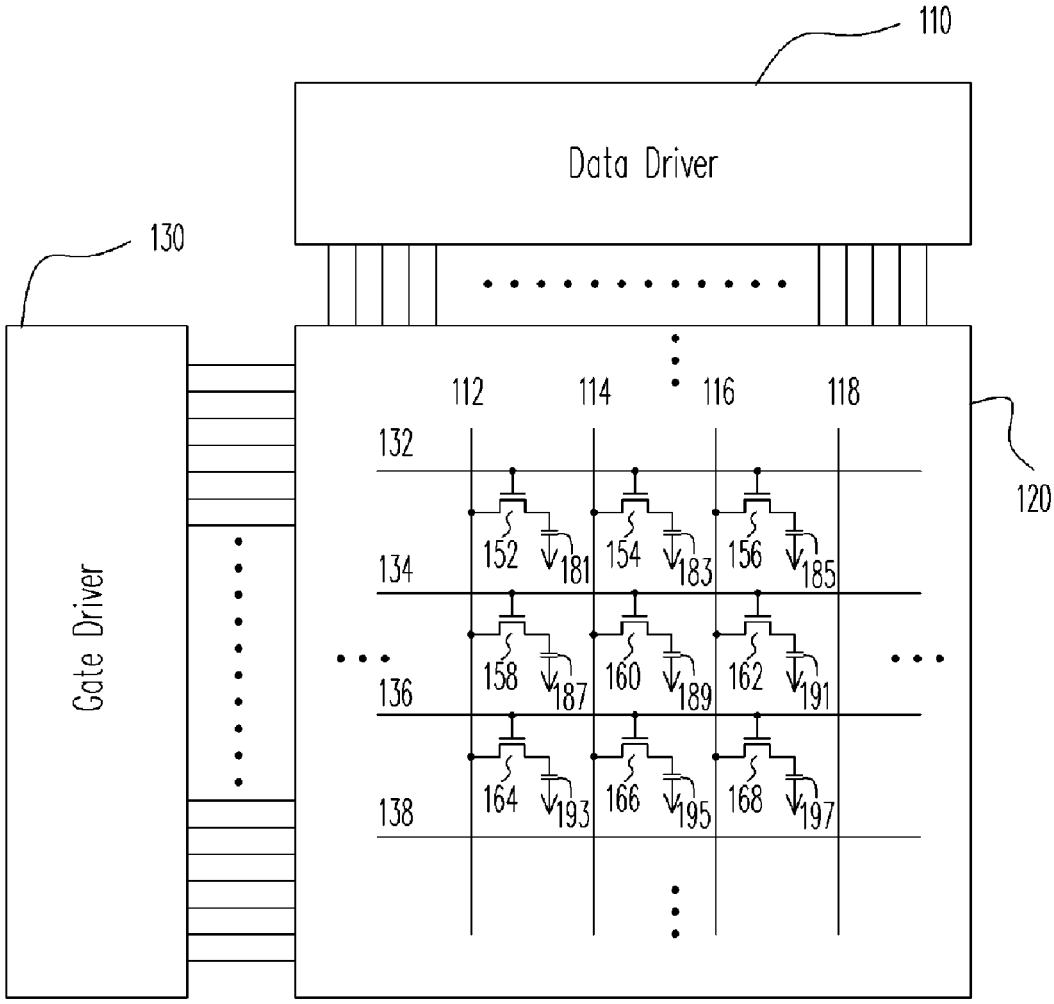
FIG. 1 (PRIOR ART)
FIG. 1 is a schematic block diagram of a conventional thin film transistor LCD.
Figure 2:
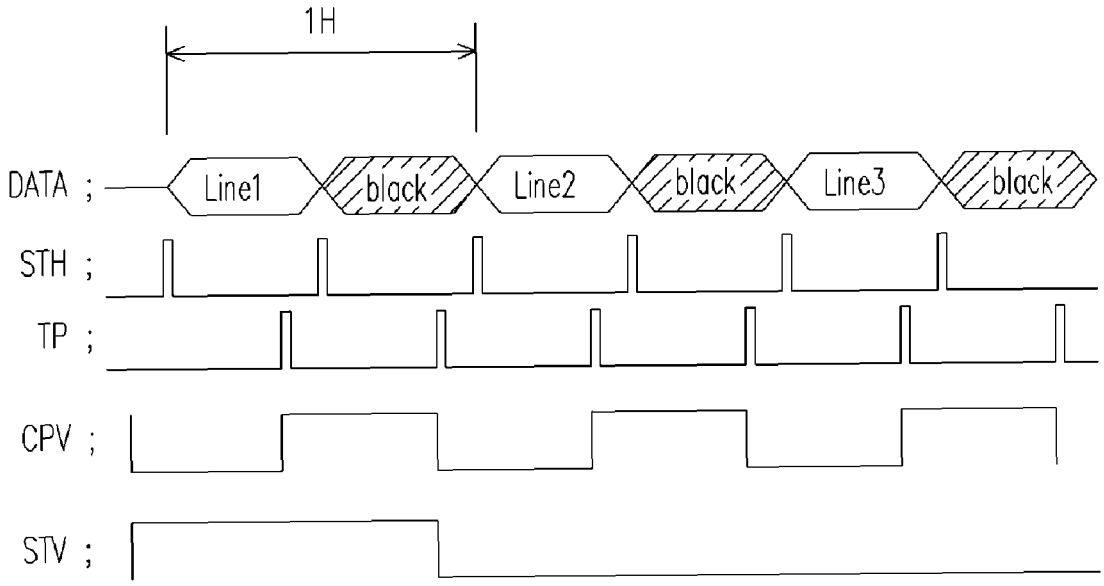
FIG. 2 (PRIOR ART)
FIG. 2 is a timing diagram of an impulse driving liquid crystal display proposed by Samsung Electronics.

According to the comparison of FIG. 2 and FIG. 4, the present invention provides apparent advantages. The normal signal and the auxiliary signal are loaded respectively within a cycle time of the start horizontal signal STH according to different levels or different states of the load signal TP. Therefore, both the normal signal and the auxiliary signal are driven once respectively within a cycle time of the start horizontal signal STH. On the contrary, two cycle times of the start horizontal signal STH are required to drive the normal signal and the auxiliary signal once according to the prior art. Hence, the present invention is advantageous compared to prior art since double frequency for the start horizontal signal and the load signal are not needed. Furthermore, the black data signal output can be controlled by the duration of the load signal TP at second level according to the present invention; that means, the duration of the load signal TP at the second level depends on the charging time required by the liquid crystal characteristics, which is unlimited. Hence, the duration of the load signal TP according to the present invention can be longer compared the duration of the load signal TP according to the prior art, as shown in FIG. 2.

Referring to FIG. 5, an operating timing diagram for the gate driver of an impulse driving apparatus for LCD according to an embodiment of the present invention is shown. The operating timing of gate lines VG1~VGn is also shown in FIG. 5, where the D stands for the duration of pixel data signals D outputted from the data driver 320 in FIG. 4. While the B stands for the duration of black data signals B outputted from the data driver 320 in FIG. 4, which means the duration of inserting black data.

According to FIG. 5, the gate driver 330 sequentially outputs scan signals to drive each gate line. In addition, the gate driver generates a black inserting scan signal after a normal scan signal to reset pixels, so as to perform the effect of impulse driving. According to an example of the operating timing shown in FIG. 5, the data driver 320 outputs pixel data signals D and gate driver 330 conducts the $i^{th}$ gate line. Then the data driver 320 outputs black data signals B, the gate driver 330 conducts the $i+j^{th}$, the $i+j+2^{th}$, and the $i+j+4^{th}$ . . . etc. gate lines concurrently to eliminate the pixel data selected by the $i+j^{th}$, the $i+j+2^{th}$, and the $i+j+4^{th}$ . . . etc. gate lines. Thus, the required impulse driving signals are being generated. For example, the timing for driving VGj+1, VGj+3, and VGj+5 . . . etc. are generated immediately after the VG1 is driven, as shown in FIG. 5. Wherein, the value of j may be one half of total gate line number or any other chosen value. Surely, A person of ordinary skill in the art will understand that above descriptions present only a typical embodiment of the present invention and not the only embodiment of the present invention.

Accordingly, an impulse driving method for LCD is concluded. The data driver of the said LCD outputs data signals to drive pixels of LCD according to the load signal received. Hence, the impulse driving method for LCD comprises at the first level of the load signal, the data driver outputs pixel data signals for driving pixels of the LCD and at the second level of the load signal, the data driver outputs black data signals for driving pixels of the LCD.

Wherein, the gate driver of the LCD generates scan signals for controlling a plurality of gate lines according to the start vertical signal and gate clock signal. When the data driver outputs pixel data signals, the gate driver conducts the $i^{th}$ gate line. Then the data driver outputs black data signals, the gate driver conducts the $i+j^{th}$ gate line to eliminate the pixel data selected by the $i+j^{th}$ gate line, hence the required impulse driving signal is generated. Alternatively, the gate driver may conduct the $i+j+2^{th}$, the $i+j+4^{th}$ . . . etc. gate lines concurrently besides the $i+j^{th}$ gate line, in order to eliminate the pixel data selected by the $i+j+2^{th}$, the $i+j+4^{th}$ . . . etc. gate lines. Thus, the required impulse driving signals are being generated.

Wherein, the value of j may be one half of total gate line number or any other chosen value. While the aforementioned first level may be a low voltage level and the second level may be a high voltage level.

Accordingly, the present invention describes an impulse driving method and apparatus for LCD with reference to FIG. 4 and FIG. 5. Wherein, a cycle time of start horizontal signal is divided into a normal cycle and a complementary cycle according to the different states of the load signal, whereby the normal signals and the auxiliary signals are loaded accordingly. Accordingly, double frequency for the start horizontal signal and the load signal can be effectively avoided, and the charge time for the storage capacitor can be kept under control. Furthermore, since the timing controller need not transmit the pixel data and the black data to the data driver alternately, and therefore requires comparatively lesser quantity of line memories and thereby reducing the overall cost of the system.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An impulse driving method for a liquid crystal display (LCD) panel, the LCD panel comprising a plurality of pixels driven by a data driver, the impulse driving method comprising:

transmitting a start horizontal signal and a load signal to the data driver;

storing a normal signal and an auxiliary signal at one cycle time of the start horizontal signal, wherein the start horizontal signal is used to control the data driver to store the normal signal and the auxiliary signal, and the one cycle time of the start horizontal signal is equal to one of a plurality of scan line times of the LCD panel corresponding to a horizontal synchronous period of a scan line; and outputting the stored normal signal to drive the pixels when the load signal is disabled during the one cycle time of the start horizontal signal, and outputting the stored auxiliary signal to drive the pixels when the load signal is enabled during the same one cycle time of the start horizontal signal, wherein the load signal is used to control the data driver to correspondingly output the stored normal signal and the stored auxiliary signal at the one cycle time of the start horizontal signal, and one cycle time of the load signal is equal to the one cycle time of the start horizontal signal, wherein the start horizontal signal is enabled and disabled just once for each scan line time during the one cycle time, and the load signal is enabled and disabled just once for each scan line time of the LCD panel during the one cycle time, and wherein the normal signal is a pixel data signal and the auxiliary signal is a black data signal as the LCD panel is normally black or a white data signal as the LCD panel is normally white, and wherein disabling times of the load signal as well as the start horizontal signal in the one cycle time of the start horizontal signal both start to occur from the time that the normal signal starts to be loaded into the pixels, and the disabling time of the load signal continuously lasts until a time that the auxiliary signal starts to be loaded into the pixels while the disabling time of the start horizontal signal continuously lasts over the total length of the disabling time of the load signal; and an enabling time of the load signal in the one cycle time of the start horizontal signal starts to occur from the time that the auxiliary signal starts to be loaded into the pixels and continuously lasts until the time a next normal signal starts to be loaded into the pixels, which means a state that the load signal changes from a disable state to an enable state triggers the auxiliary signal to be loaded into the pixels, and during the enabling time of the load signal in the one cycle time of the start horizontal signal, the enabling time of the start horizontal signal starts to occur and continuously lasts until the time that the next normal signal starts to be loaded into the pixels, which means the enabling time of the load signal starts to occur before the enabling time of the start horizontal signal and the load signal and the start horizontal signal only partially overlap, and a state that both the load signal and start horizontal signal change from the enable state to the disable state triggers the next normal signal to be loaded into the pixels.

2. The impulse driving method as recited in claim 1, wherein a voltage level of the auxiliary signal is generated by an internal circuit of the data driver integrated circuit.

3. The impulse driving method as recited in claim 2, wherein the voltage level of the auxiliary signal is a low voltage level or a high voltage level as the LCD panel is normally white.

4. The impulse driving method as recited in claim 2, wherein the voltage level of the auxiliary signal is a gamma voltage value of black as the LCD panel is normally black.

5. The impulse driving method as recited in claim 1, wherein a voltage level of the auxiliary signal is generated by an external circuit of the data driver integrated circuit.

6. The impulse driving method as recited in claim 5, wherein the voltage level of the auxiliary signal on a DC mode is a constant voltage level.

7. The impulse driving method as recited in claim 5, wherein the voltage level of the auxiliary signal on an AC mode is a non-constant voltage level.

8. The impulse driving method as recited in claim 1, further comprising generating a plurality of scan signals for controlling a plurality of scan lines of a gate driver according to a start vertical signal and a gate clock signal which are generated by the timing controller.

9. The impulse driving method as recited in claim 8, wherein when the data driver outputs the normal signal, the gate driver conducts an $i^{th}$ scan line, and when the data driver outputs the auxiliary signal, the gate driver conducts at least an $(i+j)^{th}$ scan line before the gate driver conducts an $(i+1)^{th}$ scan line, where i, j are positive integers, and j is greater than or equal to 2.

10. An impulse driving apparatus for a liquid crystal display (LCD) panel, comprising:

a timing controller, for outputting a normal signal, for generating an auxiliary signal and for outputting a plurality of control signals comprising a load signal, a start vertical signal, a start horizontal signal and a gate clock signal;

a data driver, coupled to the timing controller and the LCD panel, for receiving the load signal and the start horizontal signal and for storing the normal signal and the auxiliary signal at one cycle time of the start horizontal signal according to the start horizontal signal, and outputting the stored normal signal to drive a plurality of pixels when the load signal is disabled during the one cycle time of the start horizontal signal, and outputting the stored auxiliary signal to drive the pixels when the load signal is enabled during the same one cycle time of the start horizontal signal, wherein the start horizontal signal is used to control the data driver to store the normal signal and the auxiliary signal, and the load signal is used to control the data driver to correspondingly output the stored normal signal and the stored auxiliary signal at the one cycle time of the start horizontal signal; and a gate driver, coupled to the timing controller and the LCD panel, for generating a plurality of scan signals to control a plurality of scan lines of the LCD panel according to the start vertical signal and the gate clock signal, wherein the start horizontal signal is enabled and disabled just once for each scan line time during the one cycle time, and the load signal is enabled and disabled just once for each scan line time during the one cycle time of the LCD panel at the one cycle time of the start horizontal signal, and the one cycle time of the start horizontal signal is equal to one cycle time of the load signal and equal to one scan line time of the LCD panel corresponding to a horizontal synchronous period of a scan line, and wherein the normal signal is a pixel data signal and the auxiliary signal is a black data signal as the LCD panel is normally black or a white data signal as the LCD panel is normally white, and wherein disabling times of the load signal as well as the start horizontal signal in the one cycle time of the start horizontal signal both start to occur from the time that the normal signal starts to be loaded into the pixels, and the disabling time of the load signal continuously lasts until a time that the auxiliary signal starts to be loaded into the pixels while the disabling time of the start horizontal signal continuously lasts over the total length of the disabling time of the load signal; and an enabling time of the load signal in the one cycle time of the start horizontal signal starts to occur from the time that the auxiliary signal starts to be loaded into the pixels and continuously lasts until the time a next normal signal starts to be loaded into the pixels, which means a state that the load signal changes from a disable state to an enable state triggers the auxiliary signal to be loaded into the pixels, and during the enabling time of the load signal in the one cycle time of the start horizontal signal, the enabling time of the start horizontal signal starts to occur and continuously lasts until the time that the next normal signal starts to be loaded into the pixels, which means the enabling time of the load signal starts to occur before the enabling time of the start horizontal signal and the load signal and the start horizontal signal only partially overlap, and a state that both the load signal and start horizontal signal change from the enable state to the disable state triggers the next normal signal to be loaded into the pixels.

11. The impulse driving apparatus as recited in claim 10, wherein a voltage level of the auxiliary signal is generated by an internal circuit of the data driver integrated circuit or an external circuit of the data driver integrated circuit.

12. The impulse driving apparatus as recited in claim 11, wherein when the data driver outputs the normal signal, the gate driver conducts an $i^{th}$ scan line, and when the data driver outputs the auxiliary signal, the gate driver conducts at least an $(i+j)^{th}$ scan line before the gate driver conducts an $(i+1)^{th}$ scan line, where i, j are positive integers, and j is greater than or equal to 2.

13. The impulse driving method as recited in claim 1, wherein an enabling time of the load signal is longer than an enabling time of the start horizontal signal during the one cycle time of the start horizontal signal, and a disabling time of the load signal is shorter than a disabling time of the start horizontal signal during the one cycle time of the start horizontal signal.

14. The impulse driving method as recited in claim 1, wherein the enabling time of the start horizontal signal overlaps a part of the enabling time of the load signal, and the disabling time of the load signal overlaps a part of the disabling time of the start horizontal signal.

15. The impulse driving method as recited in claim 1, wherein the pixels display an auxiliary image when the load signal is enabled, and a writing time of the auxiliary image is substantially equal to the enabling time of the load signal during the one cycle time of the start horizontal signal.

16. The impulse driving method as recited in claim 1, wherein the pixels display a normal image when the load signal is disabled, and a writing time of the normal image is substantially equal to the disabling time of the load signal during the one cycle time of the start horizontal signal.

17. The impulse driving apparatus as recited in claim 10, wherein an enabling time of the load signal is longer than an enabling time of the start horizontal signal during the one cycle time of the start horizontal signal, and a disabling time of the load signal is shorter than a disabling time of the start horizontal signal during the one cycle time of the start horizontal signal.

18. The impulse driving apparatus as recited in claim 10, wherein the enabling time of the start horizontal signal overlaps a part of the enabling time of the load signal, and the disabling time of the load signal overlaps a part of the disabling time of the start horizontal signal.

19. The impulse driving apparatus as recited in claim 10, wherein the pixels display an auxiliary image when the load signal is enabled, and a writing time of the auxiliary image is substantially equal to the enabling time of the load signal during the one cycle time of the start horizontal signal.

20. The impulse driving apparatus as recited in claim 10, wherein the pixels display a normal image when the load signal is disabled, and a writing time of the normal image is substantially equal to the disabling time of the load signal during the one cycle time of the start horizontal signal.

* * * * *